US005344085A

United States Patent [19]

Hofseth

[11] Patent Number: 5,344,085

[45] Date of Patent: Sep. 6, 1994

[54] VACUUM DRAINAGE SYSTEM

[76] Inventor: Olav Hofseth, Dragsund, 6080 Gurskoy, Norway

[21] Appl. No.: 775,966

[22] PCT Filed: Mar. 2, 1990

[86] PCT No.: PCT/EP90/00349

§ 371 Date: Nov. 4, 1991

§ 102(e) Date: Nov. 4, 1991

[87] PCT Pub. No.: WO90/10123

PCT Pub. Date: Sep. 7, 1990

[30] Foreign Application Priority Data

Mar. 3, 1989 [NO] Norway ..... 890927

[51] Int. Cl.[5] ..... B02C 23/36

[52] U.S. Cl. ..... 241/46.02; 241/46.06

[58] Field of Search ..... 241/46.02, 46.06, 46.17, 241/58

[56] References Cited

U.S. PATENT DOCUMENTS

| | | | |
|---|---|---|---|
| 2,970,776 | 2/1961 | Buckman | 241/46.02 |
| 3,188,942 | 6/1965 | Wandel | 241/46.02 |
| 3,787,901 | 1/1974 | Wagner et al. | 4/10 |
| 3,878,569 | 4/1975 | Peirish, Jr. et al. | 4/77 |
| 3,901,131 | 9/1975 | Farrell, Jr. et al. | 241/46.02 |

FOREIGN PATENT DOCUMENTS 0287350 10/1988 European Pat. Off. .

*Primary Examiner*—Timothy V. Eley
*Assistant Examiner*—John M. Husar

[57] ABSTRACT

A vacuum drainage system for sanitary equipment such as toilets, urinals and sinks etc., comprising branching pipes connected to the sanitary equipment and ending in a collecting pipe (5), and a vacuum device (2) connected to the collecting pipe (5) producing vacuum in the pipes and transporting sewerage from the sanitary equipment to e.g. a collection tank (1) or purification plant. The vacuum device comprises one or optionally several screw pumps (2) with a mill or grinding device for grinding solid particles in the sewerage and being connected directly to the collecting pipe (5).

7 Claims, 3 Drawing Sheets

VACUUM DRAINAGE SYSTEM

BACKGROUND OF THE INVENTION

The present invention concerns a vacuum drainage system for sanitary equipment such as toilets, urinals and sinks etc., comprising branching pipes which are connected to the sanitary equipment and which open into a collecting pipe, as well as a vacuum device connected to the collecting pipe to achieve a vacuum in the pipes and transport of waste from the sanitary equipment to a collecting tank, a purifying plant, a drainage device etc.

Waste treatment devices of the above mentioned type are today dominating in connection with use aboard ships, planes and trains. However, on land such plants are also increasingly used, and the background for this is primarily the reduced use of water and the flexible system for the pipes given by such systems.

From Swedish publication no. 389.882 there is previously known a vacuum drainage system where a circulation pump is mounted in a pipe loop and is equipped to stir, divide and aerate the contents in the tank. An ejector pump is further connected to the pipe loop and produces a vacuum in the drainage system. The ejector pump is thus driven by the sewer which is circulated in the pipe loop by the circulation pump. It is, however, a major drawback with the circulation pump, which is of a centrifugal type, that it easily is clogged by textiles, sanitation utensils etc. which enters the tank. By such a clogging the pump must be removed and cleaned, something which means a break in its operation and increased operation costs. In addition it is a major disadvantage with such drainage systems that they comprise a large and space-requiring collecting tank which makes it unsuited for use in facilities, inter alia smaller boats, where the room is scarce.

The system is otherwise expensive to produce/build since it uses two pumps, an ejector pump and a centrifugal pump together with an extra pipe loop and collection tank.

The tank must have such a size and at every time be able to contain such a fluid quantity (sewer) that foaming in the tank is avoided. Foaming of the fluid results in the ejector losing its pumping effect, and it has been shown in practice that even if there is maintained a large circulating fluid quantity in the tank will foaming arise anyway in some cases, inter alia in connection with cleaning of-the toilets where soap water is supplied to the tank.

In the applicant's own Norwegian patent application no. 87.1539 there is shown a collection system for vacuum drainage systems wherein it is used a vacuum tank with two chambers an a separately driven grinder. Sewer is supplied to the first chamber of the tank and is ground and transferred to the second chamber by using the grinder. A vacuum pump, inter alia a screw pump, produces vacuum in the tank and pumps the contents of the said second chamber out of the tank. Even if one with the above mentioned system has solved the problems with clogging and operation halt, the system is comparatively expensive to build and relatively space-requiring.

SUMMARY OF THE INVENTION

It has been a purpose of the present invention to produce a vacuum drainage system which is not hampered by the above mentioned disadvantages, i.e. which:

- is more compact and simple in its construction and which thereby is especially useful on inter alia smaller boats and camping vehicles where often the room is scarce, but which simultaneously
- is cheap to produce,
- has a safe operation with small operating expenses,
- has a large effectivity,
- is simple to connect to collection tanks or purification systems, and where
- the problems associated with foaming and loss of pumping effect are avoided.

The invention will now be disclosed more closely by example and by reference to the drawn figures.

BRIEF DESCRIPTION OF THE DRAWINGS

In FIGS. 1A–1C there is shown, as mentioned above, a part of a vacuum drainage system according to the invention, comprising a collection tank 1 and two vacuum pumps; and 2 connected in parallel. The pumps are at their exit ends 3 connected to the tank via connecting lines 4 and are supplied with raw sewerage from toilets etc. (not shown) from a collection pipe 5. Each of the pumps 2 are at their inlets equipped with an air separator 6 (cfr. later paragraphs) and a not shown check valve.

In FIG. 2 there is in a larger scale shown a lengthwise view of one of the pumps shown in FIGS. 1A–1C. As is apparent, the pumps 2 are of screw type and comprise a screw housing 7 with an inner pump screw 8 with bearings 9 and 10. At the inlet ends of the pumps there is placed a grinding device or a mill 11 which comprises a mill housing 12 with a stationary knife 13 and a rotating knife 14. The mill housing 12 is further equipped with an inlet 15 with a flange to which the above mentioned air separator 6 is formed to be mounted. The rotating knife 14 is, in the shown example, mounted on the same shaft 16 as the screw 8 and is driven by a common motor (not shown). However, it is to be remarked that the knife as an alternative may be mounted on a separate shaft and may be driven by a separate motor.

Figure 1B:
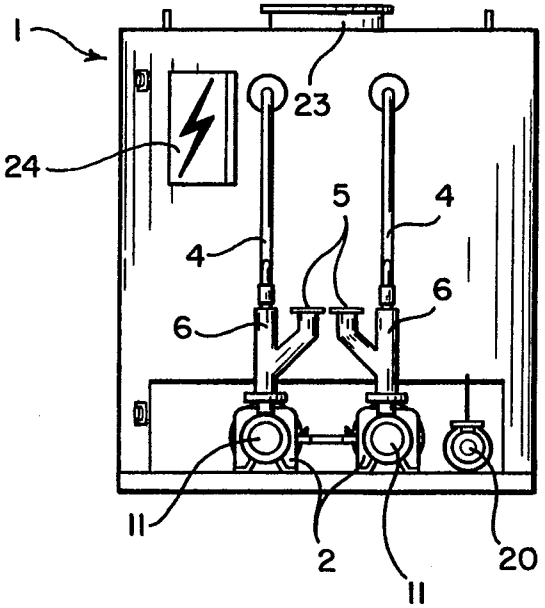
FIGS. 1A–1C show, viewed from the side, front and top, respectively a part of the drainage system according to the invention, comprising a collection tank and a screw pump.
Figure 1A:
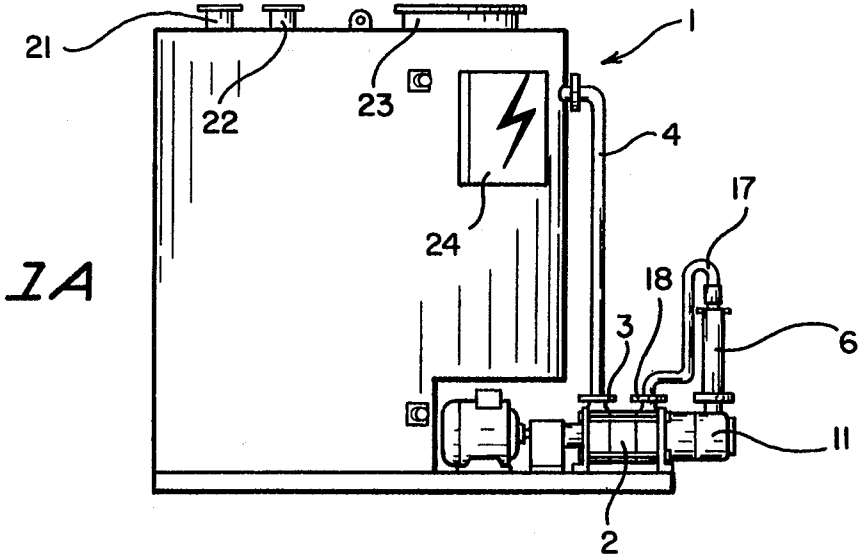
Figure 1C:
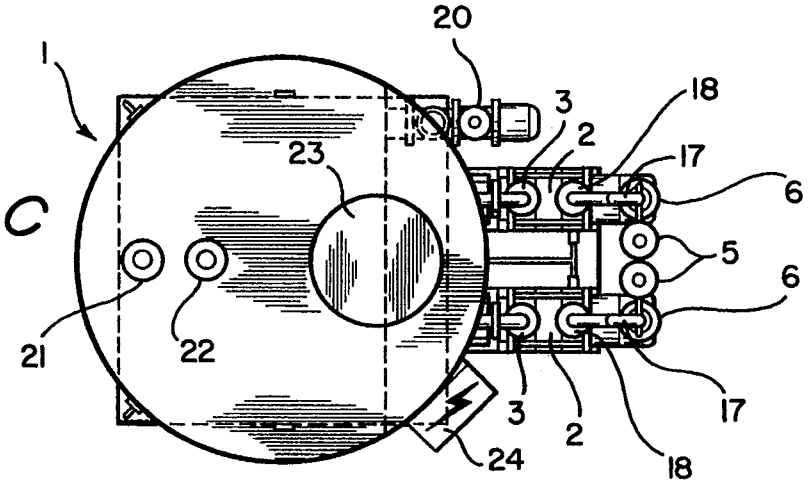

The vacuum pump works in the following way:

A vacuum switch (pressostate) is mounted in the collection pipe 5 and starts the pump (only one of the pumps is normally working at a time) when the pressure in the pipe has passed a certain level. Air and raw sewerage supplied through the collection pipe 5 is separated in the separator 6, whereby the air is led past the mill via the air pipe 17 and directly to the inlet of the pump housing 18, while the raw sewer enters the mill housing through the inlet 15. From the inlet 15 the sewerage is sucked through the mill housing 12 and optional solid elements in the sewerage, such as plastic pieces, fabrics etc., are ground by the knife blades 13, 14 before the sewerage flows along and again becomes mixed with the air at the inlet chamber 19 of the pump house. From here the sewerage and the air is axially sucked through the pump housing 7 and is pumped further via the connecting line 4 to the tank 1.

Concerning the tank 1, this is equipped with a separate pump 20 for draining the contents, a pipe end 21 with a flange for connection to a flooding pipe (not shown), a further pipe end 22 with a flange for connection to an air pipe (not shown) and an inspection hatch 23. Further, there is to the sides of the tank secured a fuse/coupling box 24. In this connection it shall be remarked that even if there in the above disclosure is specified that the pump 2 is connected to the tank 1, the invention is not limited to this example. Thus the pump may alternatively be connected to a purification system, a collection system for a public sewer pipe net, or, if the vacuum drainage system is placed on board a ship, directly to an overboard pipeline. Concerning the vacuum pump described above, the purpose of the air separator is to reduce the velocity of the flow-through in the mill (only the sewerage passes through the mill). Thereby a better grinding of the possible solid elements in the sewerage is achieved and an increase of the pumping capacity. The said pump with separator is thus especially suited for a larger vacuum drainage system where large pumping capacity is required.

Figure 2:
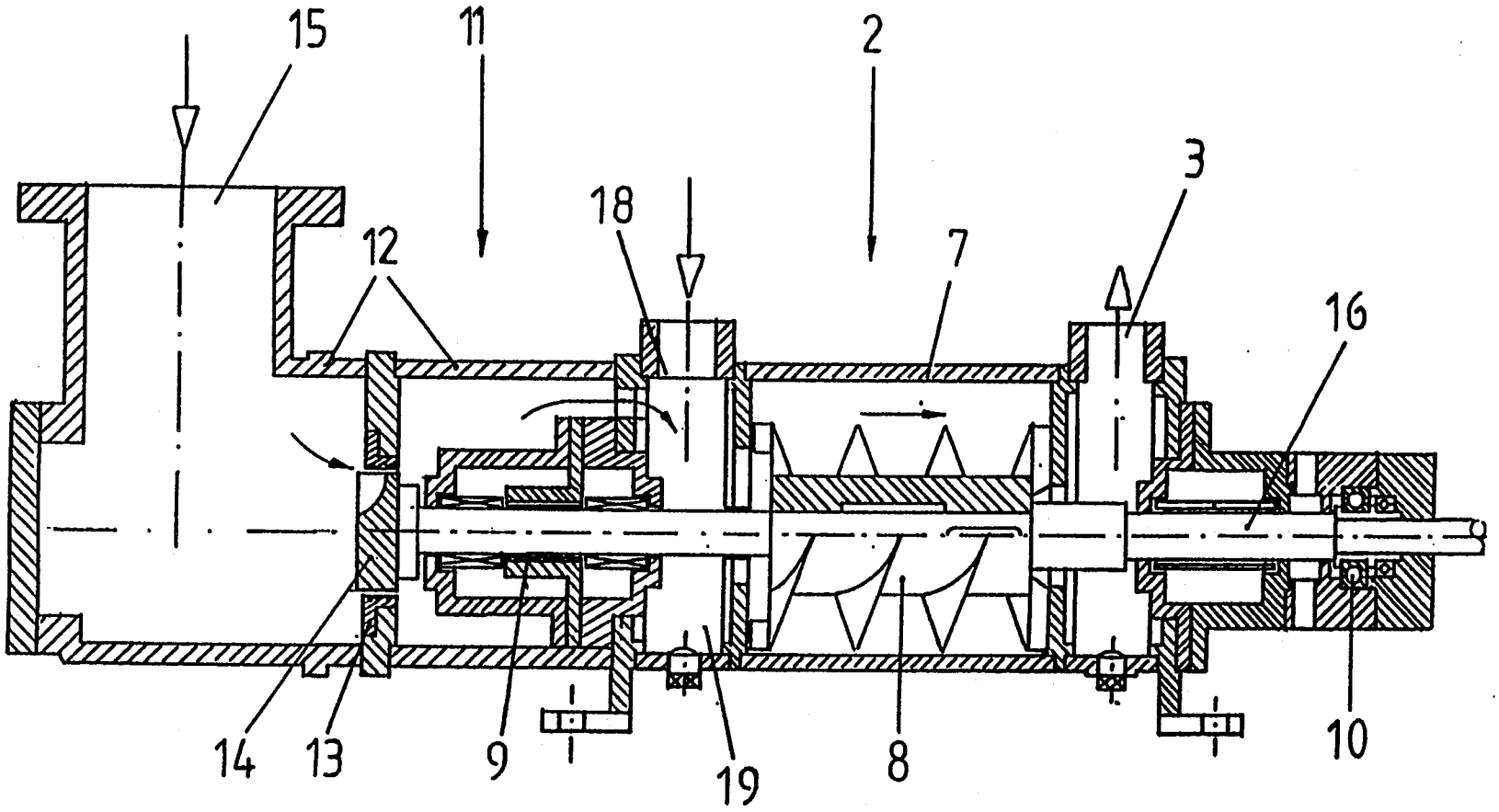
FIG. 2 shows an enlarged lengthwise sectional view of the screw pump shown in FIG. 1.
Figure 3:
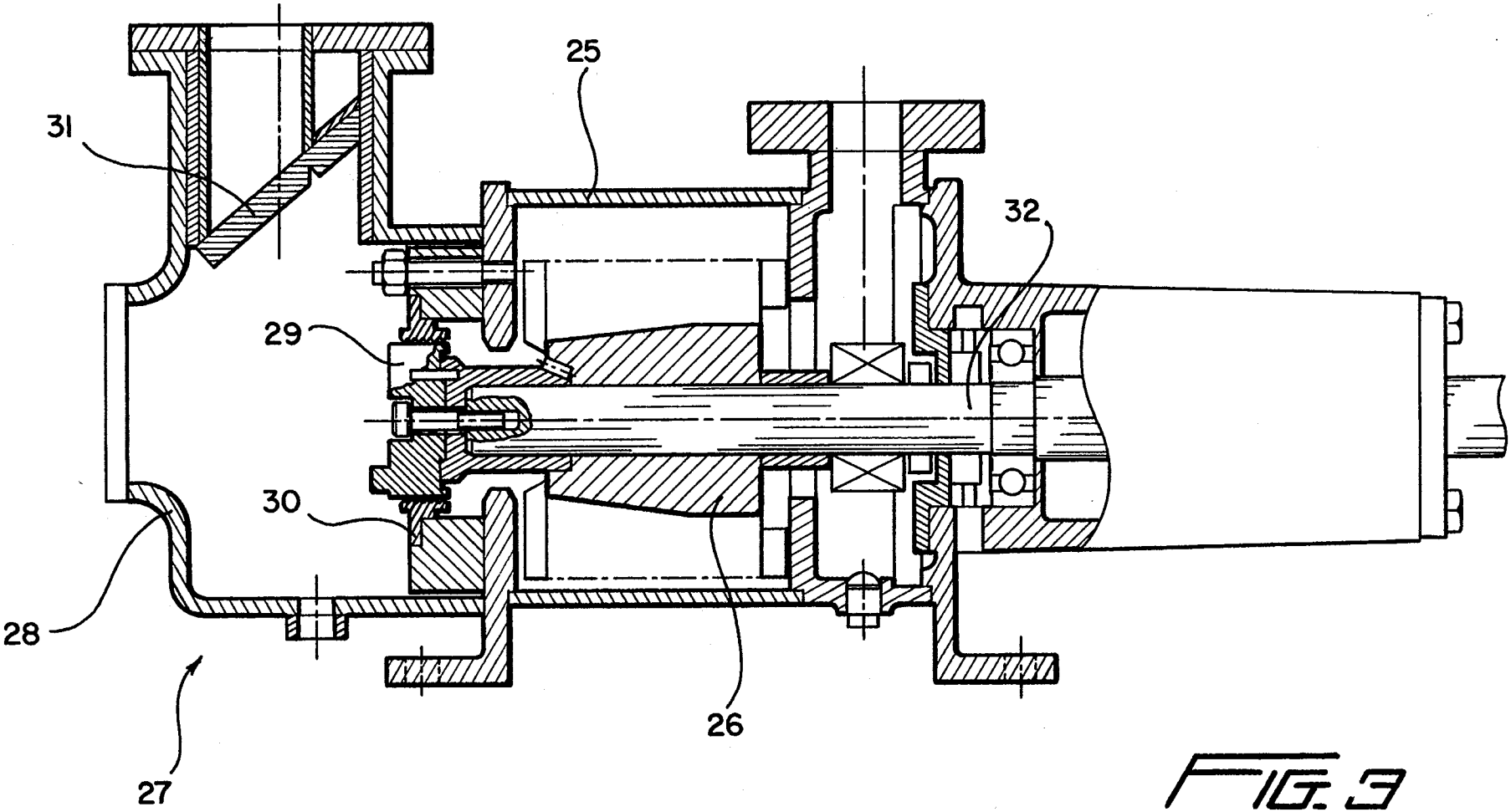
FIG. 3 shows a lengthwise sectional view of a screw pump with an alternate shape.

An alternate embodiment of the pump which is especially suited for smaller systems with small pumping capacity is shown in FIG. 3. Apart from the fact that the pump is not equipped with an air separator, its construction is mainly the same as for the pump shown in FIG. 2. It comprises a pump housing 25 with an inner pump screw 26 with bearings and a mill 27 connected to the end of the pump housing. The mill comprises a mill housing 28 with an inside stationary knife 30 and rotating knife 29. The rotating knife 29 is mounted on the same shaft as the pump screw 26 and is thus driven together with this by e.g. a not shown electromotor. At the inlet of the mill housing there is placed a check valve 31 preventing air and sewer from flowing back into the suction pipe when the pump stops (the vacuum is maintained in the suction pipe). Since the pump is not equipped with an air separator, both air and raw sewerage flows into the mill housing and further axially through the pump. The operation is otherwise the same as for the pump shown in FIG. 2.

I claim:

1. Vacuum draw type drainage system for sewerage-generating sanitary equipment comprising branching pipes connected to the sanitary equipment, at least one collection pipe, said branching pipes opening into said at least one collection pipe, and a vacuum device, said vacuum device being connected to the at least one collection pipe and being equipped with means for producing sufficient vacuum in the at least one collection pipe for drawing the sewerage from the sanitary equipment through the drainage system thereto; wherein the vacuum device comprises at least one screw pump, said at least one screw pump being equipped with a pump, said at least one screw pump being equipped with a comminuting means for grinding solid particles in the sewerage and being connected directly to the collection pipe.

2. Vacuum drainage system according to claim 1, wherein the screw pump comprises a pump housing and an internal pump screw with bearings, wherein the comminuting device is connected to an inlet end of the pump, and wherein the collection pipe is connected to an inlet of a housing of the comminuting device, whereby the sewerage first flows through the housing of the comminuting device and then axially through the pump housing.

3. Vacuum drainage system according to claim 2, wherein the comminuting device is a mill which comprises a stationary and a rotating knife, the stationary knife being mounted at an end of one of said housings while the rotating knife is connected to a shaft of the screw pump.

4. Vacuum drainage system according to claim 2, wherein an air separator is located between the collection pipe and the inlet of the housing of the comminuting device, and wherein an air pipe is located berween the air separator and the inlet end of the pump, whereby the sewerage from the sanitary equipment flows into the housing of the comminuting device while the air from the sanitary equipment is led past the comminuting device and to the inlet end of the screw pump as a means for reducing the velocity of flow through the comminuting device and increasing pumping capacity.

5. Vacuum drainage system according to claim 2, wherein a check valve is provided at the inlet of the housing of the comminuting device to prevent backflowing of air and sewerage upon stopping of the vacuum device.

6. Vacuum drainage system according to claim 1, wherein the comminuting device is connected to an inlet end of the pump, wherein an air separator is located between the collecting pipe and an inlet end of the comminuting device, and wherein an air pipe is located between the air separator and an inlet of the screw pump, whereby the sewerage from the sanitary equipment flows into the comminuting device while the air from the sanitary equipment is led past the comminuting device and into the inlet of the screw pump.

7. Vacuum drainage system according to claim 6, wherein a check valve is provided at the inlet of the housing of the comminuting device to prevent backflowing of air and sewerage upon stopping of the vacuum device.

* * * * *